United States Patent [19]

Edel et al.

[11] 3,977,755

[45] Aug. 31, 1976

[54] SCREENING ARRANGEMENT FOR A MULTI-PIN CABLE CONNECTOR

[75] Inventors: Bernhard Edel, Unterpfaffenhofen; Gerhard Pierer, Munich, both of Germany

[73] Assignee: Siemens Aktiengesellschaft, Berlin & Munich, Germany

[22] Filed: Aug. 15, 1975

[21] Appl. No.: 605,183

[30] Foreign Application Priority Data

Aug. 30, 1974 Germany ..... 2441669

[52] U.S. Cl. ..... 339/143 R; 339/196 M

[51] Int. Cl.[2] ..... H01R 23/06

[58] Field of Search ..... 339/143 R, 143 C, 166 R, 339/176 M, 184 M, 196 R, 206 P, 210 R, 210 M, 278 M, 196 M

[56] References Cited

UNITED STATES PATENTS 3,643,208 2/1972 Massa ..... 339/143 R X

FOREIGN PATENTS OR APPLICATIONS 977,312 11/1950 France ..... 339/210 M 908,759 10/1962 United Kingdom ..... 339/196 R

*Primary Examiner*—Roy Lake

*Assistant Examiner*—E. F. Desmond

*Attorney, Agent, or Firm*—Hill, Gross, Simpson, Van Santen, Steadman, Chiara & Simpson

[57] ABSTRACT

A screening arrangement for a multi-pin cable connector in which a known connector formed of synthetic material is screened by the use of a metal liner which is simply pressed into position within opposite halves of the known connector. The liner provides a low ohmic contact of the cable screen with the associated apparatus to which it is connected as well as suitable screening of the interior of the connector housing.

8 Claims, 2 Drawing Figures

SCREENING ARRANGEMENT FOR A MULTI-PIN CABLE CONNECTOR

BACKGROUND OF THE INVENTION

1. Field of the Invention

The field of art to which this invention pertains is multi-pin cable connectors and in particular to means for screening such cable connectors against electromagnetic waves.

2. Description of the Prior Art

In cable connectors the associated cable of which is itself provided with a screen, the problem arises on the one hand of connecting the cable screen through the plug-in connector, with the electrical apparatus to which the connector is fitted, and on the other, of screening the connector housing itself against electromagnetic waves. In order to connect the cable screen through to the associated apparatus, it is known from German "Offenlegungsschrift" No. 2 123 053 as laid open for inspection, to introduce special measures into the connector itself, by means of which a determinate resistance is created between the screen and the connected apparatus. A precondition, however, is that the housing of the cable connector itself must be made of a metal material so that contact between the cable screen and the associated apparatus, can be established through the housing itself.

If, however, the housing of the cable connector is made of synthetic material, then this solution cannot be employed.

SUMMARY OF THE INVENTION

It is a principal object of the present invention, considering known cable connectors having synthetic housings, to provide simple means for connecting the cable screen through to the associated apparatus and at the same time to effect screening of the interior of the cable connector generally.

A more specific object of the present invention is to provide that the internal walls of the halves of the synthetic material housing are each lined with a metal liner.

It is a further object of the present invention that each half of the synthetic material housing has a metal bracket fitted into it between which the cable screen can be clamped.

It is also an object of the invention to provide a device as described above wherein the metal liner is so formed that there is a low-ohmic connection between it and the metal bracket, as well as between the latter and the pin base.

It is also an object of the present invention to provide a metal liner as described above incorporating projecting spikes, which when the liner is fitted into position, hook into the halves of the synthetic material housing.

Another object of the present invention is to provide metal brackets for a connector which are of spring design so that with the connector assembled the cable, and therefore the cable screen, are held firmly between the metal brackets in the two halves of the connector, and in which the connector disassembled, the metal brackets are self-retaining and do not drop out of the housing.

These and other objects, features and advantages of the present invention will be understood from the following description and the associated drawing wherein reference numerals are utilized to designate a preferred embodiment.

DESCRIPTION OF THE PREFERRED EMBODIMENT

The present invention relates to a screening arrangement for a multi-pin cable connector, with a synthetic material housing in the form of two halves and a metal pin base.

An advantage of the present invention resides in the fact that by simply re-equipping a known kind of multi-pin cable connector with an easily produced metal liner in each half, not only is the connector housing itself screened but also reliable contacting of the cable screen with the associated apparatus is established, via the connector.

Figure 1:
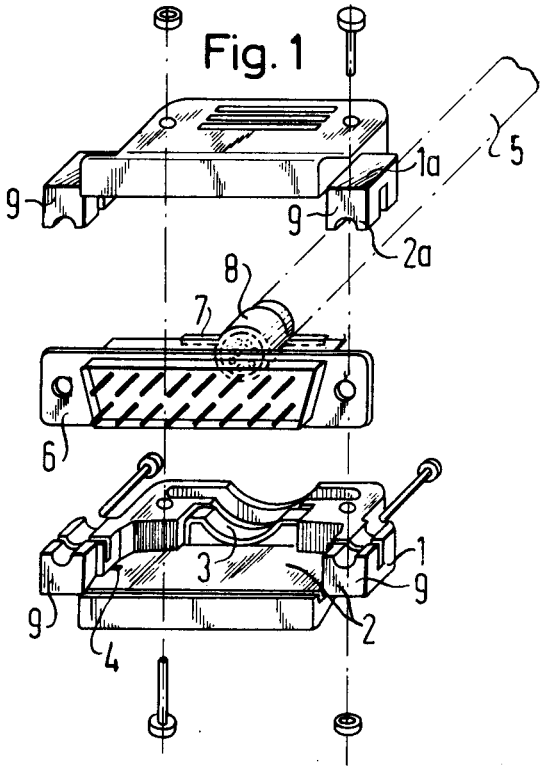
FIG. 1 is an exploded view of a known cable connector with the screening arrangement in accordance with the invention.

FIG. 1 illustrates the known cable connector which consists of the two identical halves 1 and 1*a* and the pin base 6. The pin base 6 is placed in corresponding retainer elements at the front of the two halves 1 and 1*a*, and held in position by screwing together the two halves 1 and 1*a*. In a manner which has not been illustrated, the individual wires of the cable 5 are connected to the pins of the pin base 6 so that said wires pass loosely through the connector housing and are only combined together at the point where they exist from the connector housing, by the cable clamp 7.

Because the two halves of the connector housing, 1 and 1*a*, consist of synthetic material, in order to screen the interior of the connector in accordance with the invention, a metal liner 2 is fitted into each half of the connector housing. This liner 2 is so designed that it covers the entire horizontal interior section of the two halves 1 and 1*a*. Moreover, it extends into the rear zone of the housing halves, where there is a recess. In said recess, a metal bracket 3 is fitted in such a fashion that the vertical, lateral ends of the bracket act as springs, the bracket being clamped in position in the opening. In so doing, the ends of the bracket 3 are placed in contact with the metal liner 2 and thus form a low-ohmic electrical contact therewith. This metal bracket 3, in association with the second metal bracket in the top half of the connector, forms a kind of cable clamp which acts to establish contact with the screen 8 on the cable 5. In addition, the bared cable screen 8, is introduced into the connector housing 1 and 1*a* to such an extent that it is clamped precisely between the two brackets 3 in upper and lower halves of the connector when said halves are screwed together. In this fashion, a low-ohmic electrical connection from the cable screen 8 via the two brackets to the metal liner 2 in the two halves of the connector is established.

To establish contact between the cable screen 8 and an electrical apparatus (not shown) to which the connector is connected, the metal liner 2 is provided at the front end of the connector with additional tags 9 which are bent over the left-hand and right-hand external portions of the connector halves 1 and 1*a*. As FIG. 1 shows, these tags 9 of the metal liner 2 are so disposed that the metal pin base 6 fitted into the halves of the connector housing when the connector is assembled, comes into contact with the tags 9. In this fashion, a low-ohmic electrical connection is established between the metal liner 2 and the metal pin base 6 so that overall there is a low-ohmic connection from the cable screen 8 of the cable 5, via the two brackets 3 and the liner 2 to the pin base 6. Because the pin base 6 is connected to appropriate screening arrangements of the associated electrical apparatus, for example, has good electrical contact with the apparatus housing itself, the desired effect of contact between the cable screen 8 and the apparatus is thus achieved.

Figure 2:
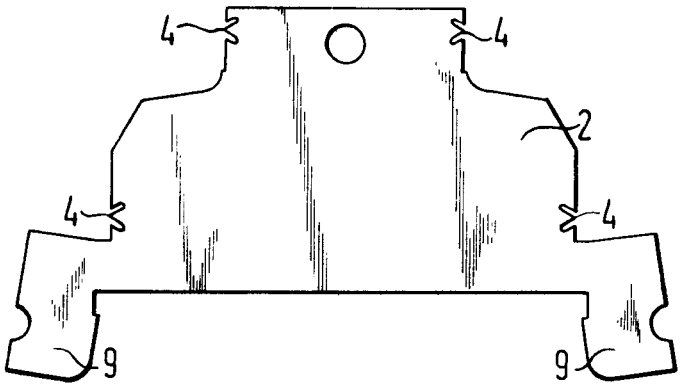
FIG. 2 is a detailed illustration of the metal liner in accordance with the invention.

An accurate illustration of the metal liner 2, all parts thereof having been shown in the same plane, is to be found in FIG. 2. The external dimensions of the metal liner 2 correspond to the internal dimensions of the halves 1 and 1*a* of the connector housing. FIG. 2 illustrates the simple and advantageous method of attaching the metal liner in each case to one half of the connector. For this purpose, at four locations on the external edge of the metal liner 2, a metal spike 4, is provided, the tip of which projects beyond the actual profile of the liner 2. When the liner 2 is fitted into one of the halves 1, 1*a* of the connector, these spikes 4 hook into the synthetic material wall thereof. In this fashion, the metal liner 2 can be assembled quite simply, and also reliably secured against dropping out. FIG. 2 also shows how the metal liner 2 complete with the tags 9 can be manufactured in one piece, for example by punching, and how the tags 9 can be given the requisite form by a simple bending operation.

We claim as our invention:

1. A multi-pin cable connector comprising:

a housing formed of synthetic material and including a pair of mating halves and a metal pin connector base for being secured within the housing, said metal pin connector base having means for being coupled to a multi-wire cable having an associated cable screen, each of the internal walls of said mating halves having a metal liner and a metal bracket, said metal brackets of respective halves of said housing being arranged to clamp the cable screen therebetween wherein the housing halves are assembled, said metal brackets, liners, and pin base being associated together within the housing to form low-ohmic contacts between each of said brackets, liners and pin base.

2. A multi-pin cable connector in accordance with claim 1 wherein each of said housing halves has a main recess for receiving the pin connector base and a further recess for receiving said cable screen, said metal liner extending across the surface of said main recess and said metal bracket being held into position in said further recess.

3. A multi-pin connector in accordance with claim 1 wherein said metal liner has projecting spikes which lodge into the respective halves of the synthetic material housing, thereby locking the liner into position.

4. A multi-pin connector in accordance with claim 1 wherein said liner is formed from a liner blank having tabs which are bent into position to make low-ohmic contacts with the pin connector base.

5. A multi-pin connector in accordance with claim 1 wherein the metal brackets are of spring material such that the assembling of the connector housing causes the cable screen to be lockingly held in position therein.

6. A multi-pin connector in accordance with claim 5 wherein the metal brackets are self-spring biasing within the respective housing halves to be self-retaining such that they do not become dislodged when the housing is dismantled.

7. A multi-pin connector in accordance with claim 6 wherein said metal brackets each comprise partially circular collar portions for clamping the cable screen therebetween and each bracket has a pair of supporting legs for making low-ohmic contact with said metal liner.

8. A multi-pin connector in accordance with claim 4 wherein each of said tabs is bent perpendicularly to the plane of the metal liner blank and wherein each tab of both of said liners make low-ohmic contact with said metal pin base.

* * * * *